United States Patent [19]

Verzilli et al.

[11] Patent Number: 4,759,102

[45] Date of Patent: Jul. 26, 1988

[54] CLEANING APPARATUS FOR CLEANING THE FLATS OF A REVOLVING FLATS CARD

[75] Inventors: Giuseppe Verzilli, Wiesendangen; Erich Hohloch, Winterthur, both of Switzerland

[73] Assignee: Rieter Machine Works Ltd., Winterthur, Switzerland

[21] Appl. No.: 84,869

[22] Filed: Aug. 13, 1987

[30] Foreign Application Priority Data

Aug. 15, 1986 [CH] Switzerland ..... 03289/86

[51] Int. Cl.[4] ..... D01G 15/78

[52] U.S. Cl. ..... 19/111

[58] Field of Search ..... 19/111, 108, 109, 110

[56] References Cited

U.S. PATENT DOCUMENTS

| | | | |
|---|---|---|---|
| 624,861 | 5/1899 | Philipson | 19/111 |
| 2,929,113 | 3/1960 | Hess | 19/111 |
| 3,604,061 | 9/1971 | King | 19/111 X |
| 4,126,915 | 11/1978 | Zieg et al. | 19/111 |
| 4,368,561 | 1/1983 | Trützschler | 19/111 |

FOREIGN PATENT DOCUMENTS

| | | |
|---|---|---|
| 0052845 | 10/1889 | Fed. Rep. of Germany . |
| 0376996 | 6/1923 | Fed. Rep. of Germany . |
| 0501069 | 2/1971 | Switzerland . |

*Primary Examiner*—Louis K. Rimrodt

*Attorney, Agent, or Firm*—Werner W. Kleeman

[57] ABSTRACT

The cleaning apparatus for cleaning the set of flats of a revolving flats card has a shaft supported by a carrier. The shaft is pivotable about the lengthwise axis of the shaft together with a cleaning brush fixedly mounted on the shaft and extending over the width of the card. In accordance with the invention, the carrier is movably mounted on the card framework in such a manner that at the flats cleaning position the spacing of the path of movement of the cleaning brush from the set of flats is variable, whereby during the pivotal movement of the cleaning brush effecting cleaning of the flats clothing the spacing of the path of movement of the cleaning brush from the set of flats at the flats cleaning position is smaller than during the return movement of the cleaning brush. The cleaning apparatus affords the advantage of improved cleaning of the flats clothing. In a special embodiment, improved cleaning of the cleaning brush, and thus additional improvement in cleaning of the flats clothing, is also obtained.

7 Claims, 3 Drawing Sheets

CLEANING APPARATUS FOR CLEANING THE FLATS OF A REVOLVING FLATS CARD

BACKGROUND OF THE INVENTION

The present invention relates to a new and improved cleaning apparatus for cleaning the flats of a revolving flats card.

Generally speaking, the cleaning apparatus for cleaning the set of flats of a revolving flats card comprises a carrier or support located on the side of the set of flats or the flats thereof provided with clothing. A shaft is rotatably or pivotably supported on the carrier. A cleaning brush is fixedly secured to this movable shaft, the cleaning brush passing over the clothing of the flats at a flats cleaning position located outside the carding zone of the card. The cleaning brush extends over the length of the set of flats, in other words transversely or in the cross-machine direction. The cleaning brush is pivotable together with the shaft about the lengthwise axis thereof, the pivotal movements of the shaft and the cleaning brush consisting of alternate cleaning and return movements.

In a carding machine the main or carding cylinder, which is fitted with needles or wire teeth or the like on its cylindrical surface, during the course of its rotation carries along the fiber material fed thereto and moves this fiber material between its own clothing and that of the flats in the set of card flats which normally move in the opposite direction. In this manner, the fibers of the fiber material or stock are parallelized. Furthermore, the fibers of the fiber material are subjected to a cleaning action. Impurities such as husk fragments, neps and the like accumulate during this cleaning action in the clothing of the flats. Accordingly, during operation of the card, the clothings of the flats must be continually cleaned. This is performed by cleaning brushes or brush members projecting into the clothing of the flats at a cleaning zone located outside the carding zone.

In accordance with the teachings of Swiss Pat. No. 561,294, the so-called flats strippings or strips are released from the clothing of the flats by an oscillating brush and pass as a coherent web into the path of movement of an oscillating comb. The needles of this comb penetrate the web and separate strips from the run of the web; when the needles of the oscillating comb have an upright disposition the strips fall away from them. Additionally, a rotating brush cleans the flats clothing of husks and the like.

This cleaning apparatus has the disadvantage that cleaning of the flats clothing is not effected with sufficient thoroughness and impurities or contaminants are not extracted from the flats clothing to an adequate extent.

SUMMARY OF THE INVENTION

Therefore with the foregoing in mind, it is a primary object of the present invention to provide a new and improved cleaning apparatus for cleaning of the flats of a revolving flats card in a manner not afflicted with the aforementioned shortcomings and disadvantages of the prior art cleaning devices.

Another and more specific object of the present invention aims at the provision of a new and improved cleaning apparatus for cleaning the flats of a revolving flats card in a particularly controlled, reliable and efficacious manner.

Still a further noteworthy object of the present invention is directed to a new and improved cleaning apparatus for cleaning the flats of a revolving flats card in an extremely thorough manner such that even impurities or contaminants or the like situated deeply and clinging tenaciously in the clothing of the flats can be effectively engaged and reliably removed therefrom due to a controlled penetration of the cleaning brush at the clothing of the flats during the cleaning action and the removed impurities or contaminants or the like—the so-called strippings or strips—adhering to the brush are restrained from re-entering the clothing of the flats due to a likewise controlled return movement of the cleaning brush.

Yet a still further noteworthy object of the present invention is concerned with imparting to the cleaning implement, such as a cleaning brush of a cleaning apparatus for cleaning the flats of a revolving flats card, a predeterminate controlled movement during various contemplated motion phases of the cleaning brush to ensure for positive and reliable extraction of impurities or the like from the flats clothing while minimizing undesired re-entry of the impurities or the like engaged by the cleaning brush during its return movement away from the flats.

A further significant object of the present invention is directed to a new and improved cleaning apparatus for cleaning the flats of a revolving flats card in a highly reliable and effective manner, and which cleaning apparatus is relatively simple in construction and design, extremely effective in its cleaning operation, quite economical to fabricate, relatively uncomplicated to install at carding machines, not readily subject to breakdown or malfunction, and requires a minimum of maintenance and servicing.

Now in order to implement these and still further objects of the present invention, which will become more readily apparent as the description proceeds, the cleaning apparatus for cleaning the flats of a revolving flats card is manifested by the features that the carrier is movably mounted on the card framework and through movement of the carrier the spacing of the path of movement of the cleaning brush from the set of flats at the flats cleaning position is variable, whereby during the cleaning movement of the cleaning brush this spacing is smaller than during the return movement of the cleaning brush.

The movement or shifting of the pivotal path of movement of the cleaning brush, directed towards the set of flats, permits catching and removal of even impurities located right at the base of the clothing of the flats. Furthermore, during the return movement of the cleaning brush, no dirt particles or impurities or contaminants are pushed into the flats clothing. The provision of an additional rotating brush, as is the case in the cleaning apparatus disclosed in the aforementioned Swiss Pat. No. 561,294, proves to be unnecessary when the cleaning apparatus is constructed in accordance with the teachings of the present invention.

BRIEF DESCRIPTION OF THE DRAWINGS

The invention will be better understood and objects other than those set forth above will become apparent when consideration is given to the following detailed description thereof. Such description makes reference to the annexed drawings, wherein throughout the various figures of the drawings there have been generally used the same reference characters to denote the same or analogous components and wherein.

DETAILED DESCRIPTION OF THE DRAWINGS

Describing now the drawings, it is to be understood that to simplify the showing thereof only enough of the structure of the inventive cleaning apparatus and the related carding machine or card have been illustrated therein as is needed to enable one skilled in the art to readily understand the underlying principles and concepts of the present invention.

Figure 1:
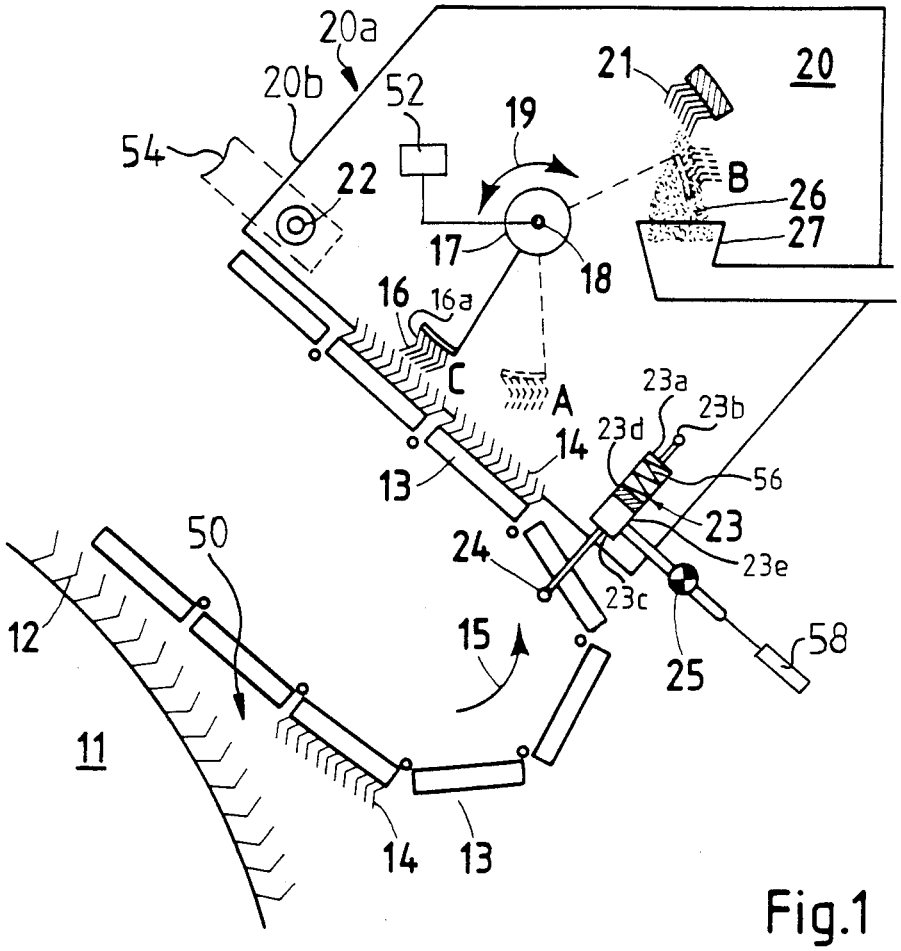
FIG. 1 schematically illustrates a cleaning apparatus for cleaning the flats of a revolving flats card and constructed in accordance with the present invention.

Turning now specifically to FIG. 1 of the drawings, the arrangement of the first exemplary embodiment of cleaning apparatus and the related carding machine illustrated therein by way of example and not limitation will be seen to comprise a rotating main or carding cylinder 11 of a carding machine or card which is equipped with needles or wire teeth 12 or the like fitted to the substantially cylindrical outer surface thereof. A set of revolving flats 13*a* comprises individual elements or flats 13 each of which is provided with flats clothing or clothing 14. In operation, the set of revolving flats 13*a* travels relatively slowly in the direction of the arrow 15 through the carding zone generally indicated by reference numeral 50. A cleaning brush or brush member 16, extending over the complete width of the card, i.e., in the cross-machine direction, is fixedly secured to a movable shaft or shaft member 17 which can be appropriately driven by any suitable and thus merely schematically indicated drive means 52, such as a suitable drive motor. The cleaning brush or brush member 16 is pivotable in conjunction with the pivotal movements of the pivotable shaft 17 pivotably driven by the drive means 52, as indicated by the double-headed arrow 19, about the lengthwise of longitudinal axis 18 of the pivotable shaft 17 between the positions A and B indicated in dotted lines and through the intermediately indicated position C, as will be explained more fully hereinafter.

The shaft 17 extends between two plates 20 or the like arranged at substantially right angles thereto, only one of these two plates 20 being visible in the showing of FIG. 1 in order to simplify the illustration. The shaft 17 is carried by the plates or plate means 20 which also carry a comb 21 for cleaning of the cleaning brush 16. The plates 20 are combined into a unit by means of non-illustrated but conventional structural elements, such as connecting elements, to form a carrier or support, generally indicated by reference character 20*a*, for the movable, here pivotable shaft 17.

Furthermore, a carrier or support rod 22 is provided which is secured to the associated conventional card framework or housing structure, generally schematically indicated by reference character 54. The carrier or support rod 22 serves for pivotally supporting the plates 20 and the carrier or support 20*a* containing the same. In addition, the plates 20 and such carrier or support 20*a* are supported at one end 23*a* of a piston-and-cylinder unit 23 at the support point of location 23*b*, the other end 23*c* of which piston-and-cylinder unit 23 is connected to a securing or fastening point or location 24 on the card framework 54. The piston 23*d* of the piston-and cylinder unit 23 is movable in one direction by means of a suitable pressure or pressurized fluid or fluid medium and in the other direction by means of a compression spring 56 or equivalent structure. The pressure fluid or fluid medium is supplied to the cylinder 23*e* of the piston-and cylinder unit 23 by a valve 25 or other suitable fluid medium infeed and outfeed control element which, in turn, is appropriately controllable by means of any suitable known control device 58.

In operation, the set of flats 13*a* moves slowly (for example 25 cm/min.) in the direction indicated by the arrow 15. As indicated by the double-headed arrow 19, the cleaning brush or brush member 16 performs oscillations or pivotal movements (for example 40 per minute). The oscillating movements of the cleaning brush or brush member 16 constitute a cleaning movement (serving to clean the flats clothing 14) from the end or terminal position A via the position C to the end or terminal position B, and a return movement from the end or terminal position B back to the end or terminal position A. The intermediate position C represents the point at which the clothing 14 of the set of flats 13*a* is cleaned, i.e. the flats cleaning position. Since this flats cleaning position coincides with the position C, it is also designated by the reference numeral C in the following description. To enable removal of material particles or other impurities or contaminants or the like picked up by the cleaning brush 16 from such cleaning brush 16, the latter is moved through a comb 21 during its oscillating movement, and specifically at the region of the position B.

In operation, the piston-and-cylinder unit 23 is operated in synchronism with the oscillating or pivotal movements of the cleaning brush or brush member 16. By opening or otherwise suitably operating the valve 25 or the like by means of the valve control device 58 at the desired point or moment of time such enables the pressure or pressurized fluid to exert pressure on the piston 23*d* of the piston-and-cylinder unit 23 so that this piston or piston member 23*d* is moved in the direction away from the securing position 24 while the compression spring 56 provided in the piston-and-cylinder unit 23 is compressed. The plates 20 and hence the carrier or support 20*a* are thus pivoted in a counter-clockwise direction around the carrier or support rod 22. A separate piston-and-cylinder unit 23, forming a drive means for the carrier or support 20*a*, can be provided for each plate or plate member 20 or a common piston-and-cylinder unit 23 can be provided to form a common drive means for both plates 20. Since the pivotable or oscillatable shaft or shaft member 17 is supported by the plates 20 of the carrier or support 20*a*, the spacing of the path of movement of the cleaning brush or brush member 16 from the set of flats 13*a* at the flats cleaning position C is increased during this pivotal movement, that is the plates 20 and thus the path of movement of the cleaning brush 16 are brought into a position spaced from the flats cleaning position C of the set of flats 13*a*.

As previously explained, the valve 25 of the piston-and-cylinder unit 23 is operable by the valve control means or device 58 which can, for example, be an electrical control circuit as is conventionally used for controlling the operation of a valve for controlling the admission and release of pressurized fluid medium to and from a piston-and-cylinder unit or the like. As will be readily evident, the piston 23*d* of the piston and cylinder unit 23 is appropriately controllably moved by controlling the operation of the valve 25, and thus the carrier or support 20*a* is correspondingly moved by virtue of the movement of the piston or piston member 23*d*. The return movement of the piston 23*d* to its initial position is effected by venting of the pressure or pressurized fluid medium from the cylinder 23*e* of the piston-and-cylinder unit 23 by appropriately operating the valve 25 controlled by the valve control means or device 58, and by the bias applied by the compression or return spring 52. Thus, the plates 20 and hence the carrier or support 20*a* are pivoted in the clockwise direction around the carrier or support rod 22, and the carrier or support 20*a* moves into a position close to the set of flats 13*a* at the flats cleaning position C. In other embodiments or as a modification of the exemplary embodiment shown in FIG. 1, alternative control means, for example cam discs and the like, can be used for control of the piston-and-cylinder unit 23. In such case the just-mentioned modified control means or devices therefor comprise both the control means and the drive means.

In the exemplary embodiment of FIG. 1, during the flats cleaning movement of the cleaning brush or brush member 16 during its travel from the position A to the position C the pressure in the cylinder 23*e* of the piston-and-cylinder unit 23 is appropriately reduced before the flats cleaning position C is reached by such cleaning brush or brush member 16, whereby the carrier or support 20*a* and thus the path of movement of the cleaning brush or brush member 16 is moved into a position close to the set of flats 13*a* at the cleaning position C where such brush 16 cleans the clothing 14 of the flats 13 of the set of flats 13*a*. During the return movement of the cleaning brush or brush member 16 from the end position B to the other end position A, the valve 25 is opened or appropriately operated by the control means or device 58 before the cleaning brush 16 reaches the position C, and thus the spacing of the path of movement of the cleaning brush 16 from the set of flats 13*a* is increased at the flats cleaning position C and hence the path of movement of the cleaning brush 16 is brought into a position spaced from the set of flats 13*a* at the flats cleaning position or cleaning position C.

Stated another way, during the time that the cleaning brush 16 moves from the one end position A through the flats cleaning position C to the other end position B the carrier or support 20*a* is pivoted or rocked in clockwise direction about the carrier rod 22 under the action of the controlled valve 25 which appropriately reduces the pressure effective in the piston-and-cylinder unit 23 so that the path of movement of the cleaning brush 16 is at a lesser spacing from the set of flats 13*a* to effectuate intensive cleaning of the clothing 14 thereof, whereas when the cleaning brush 16 is now moved back or returned from the end position B through the flats cleaning position C into the end position A the carrier or support 20*a* is pivoted or rocked in the counter-clockwise direction under the action of the controlled valve 25 which now appropriately pressurizes the piston-and-cylinder unit 23, whereby the path of movement of the cleaning brush 16 when located at position C is situated further away from the set of flats 13*a* and does not or only ineffectively cleans the clothing 14 of the flats 13 thereof.

This affords the notable advantage that during the actual cleaning movement contemplated for the clothing 14 of the set of flats 13*a* i.e. the flats 13 thereof and when the cleaning brush or brush member 16 moves from the end position A towards the end position B, the cleaning brush or brush member 16, with its clothing cleaning teeth or bristles 16*a* or the like in operating or cleaning position, penetrates deeply into the flats clothing 14 and intensively strips or removes impurities or contaminants or the like contained thereat. Furthermore, during the return movement of the cleaning brush 16 from the end or terminal position B to the end or terminal position A the cleaning brush or brush member 16 penetrates only to a slight extent or not at all into the flats clothing 14 so that the strip material or impurities or the like present in such flats clothing 14 and which is to be removed, is not undesirably forced against the base of the flats clothing 14 where such would be at least more difficult if not virtually impossible to extract.

It should be clear that by virtue of the teachings of the present invention the effective depth of penetration of the cleaning brush or brush member 16 into the clothing 14 of flats 13 of the set of flats 13*a* can be selected in a desired manner. This enables accomplishing an optimum cleaning of the flats clothing 14 and adaptation of the flats clothing cleaning operation to various conditions encountered during operation of the cleaning apparatus.

After the cleaning brush or brush member 16 has begun its return movement from the end or terminal position B towards the end or terminal position A, it passes through the comb 21 serving for cleaning of such cleaning brush or brush member 16, whereby the flats strippings or accumulations 26, in other words, the previously removed impurities or contaminants or the like carried by the cleaning brush or brush member 16 fall away insofar as they have not already done so in the course of the cleaning movement effected during movement of the cleaning brush or brush member 16 from the position A to the position B. The removed flats strippings or strips or accumulations 26 are carried away by a suitable receiving container or receptacle 27. In the illustrated embodiment, the brush cleaning comb 21 is mounted on the plates 20.

Figure 2:
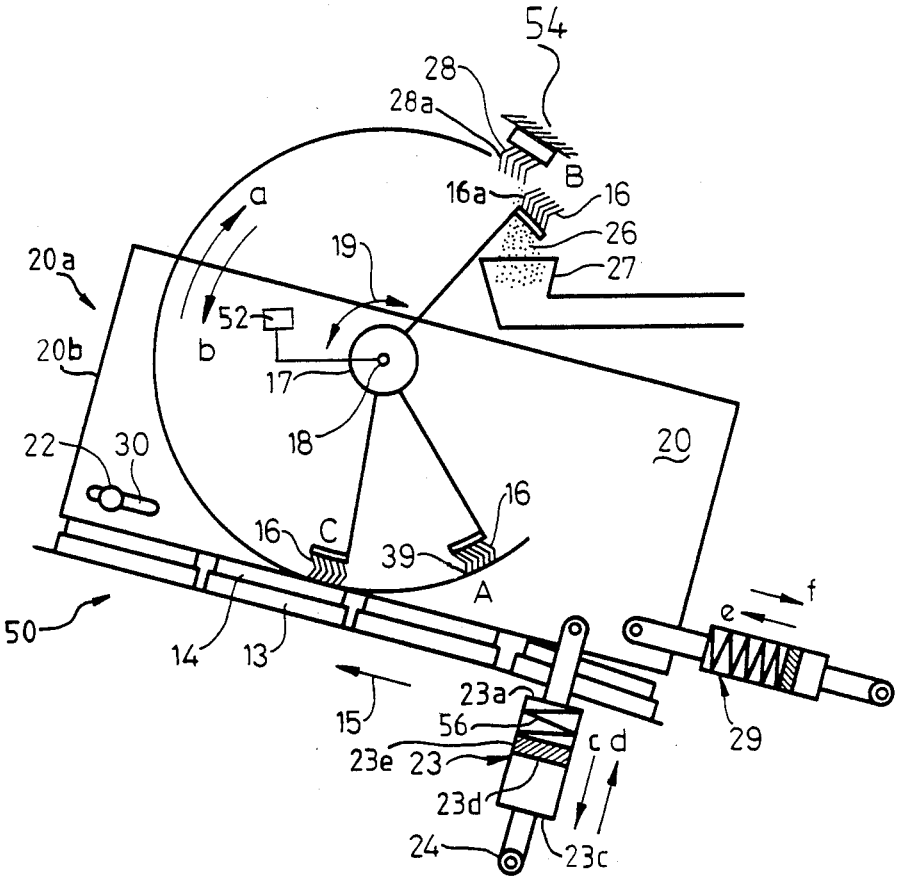
FIG. 2 schematically illustrates a further embodiment of a cleaning apparatus for cleaning the flats of a revolving flats card and constructed in accordance with the present invention.

The carrier or support rod 22 is advantageously mounted close to one side edge 20*b* of the plates or plate members 20 in such a manner that, as illustrated in FIG. 1 and also for the embodiment depicted in FIG. 2, the cleaning brush clothing or the like defined by the needles or bristles 16*a* when located at the flats cleaning position C and the carrier or support rod 22 are located at approximately the same height above an imaginary plane defined by the horizontal or linearly extending surface of the set of flats 13*a* at the flats cleaning position C. As a result there is realized the desired movement of the carrier or support 20*a* at the flats cleaning position C in a direction upwards and downwards practically normal to the set of flats 13*a*.

In the further exemplary embodiment depicted in FIG. 2 where there have been generally employed the same reference characters to denote the same or analogous components, there are again depicted the individual elements or flats 13 of a set of flats 13*a* of a revolving flats card, each such individual flat 13*a* being provided with a clothing 14. The direction of movement of the set of flats 13*a* is indicated by the arrow 15. A cleaning brush or brush member 16 is again supported by a shaft 17 and is pivotable or oscillatable back and forth about the lengthwise or longitudinal axis 18 of the movable, here again pivotable shaft or shaft member 17 between the end or terminal positions A and B through the intermediate position C, as indicated by the double-headed arrow 19. The shaft 17 is supported by two plates 20 arranged at substantially right angles to the shaft 17 and again constituting part of a carrier or support 20*a*. In this exemplary embodiment a brush cleaning comb or comb member 28 for cleaning the flats cleaning brush or brush member 16 is fixedly secured to the here likewise merely schematically illustrated card framework or housing structure 54. Similar to the first described embodiment of FIG. 1, here also there are provided a carrier or support rod 22 and a piston-and-cylinder unit 23 which serves as a drive means for the carrier or support 20*a* including the carrier plates 20 thereof. The piston-and-cylinder unit 23 serves, in the manner previously explained, for pivoting of the plates or plate members 20 of the carrier or support 20*a* for the purpose of varying the spacing of the path of movement of the flats clothing cleaning brush or brush member 16 at the flats cleaning position C, from the set of flats 13*a* formed by the individual elements or flats 13 or from the clothing 14 thereof. Finally, a receiving container or receptacle 27 is again provided for the flats strippings or strips or accumulations 26 or the like.

In contrast to the embodiment of FIG. 1, in the cleaning apparatus of the modified embodiment of FIG. 2 an additional piston-and-cylinder unit 29 is provided which serves as a drive means for the carrier or support 20*a* including the plates or plate members 20 thereof. This piston-and-cylinder unit 29 serves for shifting of these plates 20 in translational movements in a direction substantially parallel to the longitudinal extension or direction of extent of the flats 13 of the set of flats 13*a* at the cleaning position C. In order to enable such movements, the plates 20 are beneficially provided with elongate slots 30 or equivalent structure. These plates or plate members 20 are supported by the carrier or support rod 22 and the piston-and-cylinder unit 23. The flats cleaning position is again the region of the cleaning brush or brush member 16 located approximately at the position C.

In the cleaning apparatus of the embodiment of FIG. 2, the cleaning brush or brush member 16 is therefore capable of the following movement components or movements:

- pivotal movements or movement components a and b;
- movements or movement components c and d at essentially right angles or orthogonally to the surface of the set of flats 13*a* or individual flats 13;
- movements or movement components e and f essentially parallel to the longitudinal extension or direction of extent of the set of flats 13*a* or individual flats 13.

A variety of possibilities for varying the path of movement of the cleaning brush or brush member 16 arises from the combination of the individual movements or movement components and the speed of the movement can also be included in these possibilities. For purposes of further explanation, the mode of operation of the following exemplary embodiment will be considered in greater detail.

In this embodiment, movements in accordance with the movement components a and c are carried out at the start of the cleaning movement starting from the end or terminal position A of the cleaning brush or brush member 16. During passage of the cleaning brush or brush member 16 through the flats cleaning position or flats clothing cleaning position C the movement component f is carried out and immediately thereafter there is accomplished the movement according to the movement component d.

Figure 3:
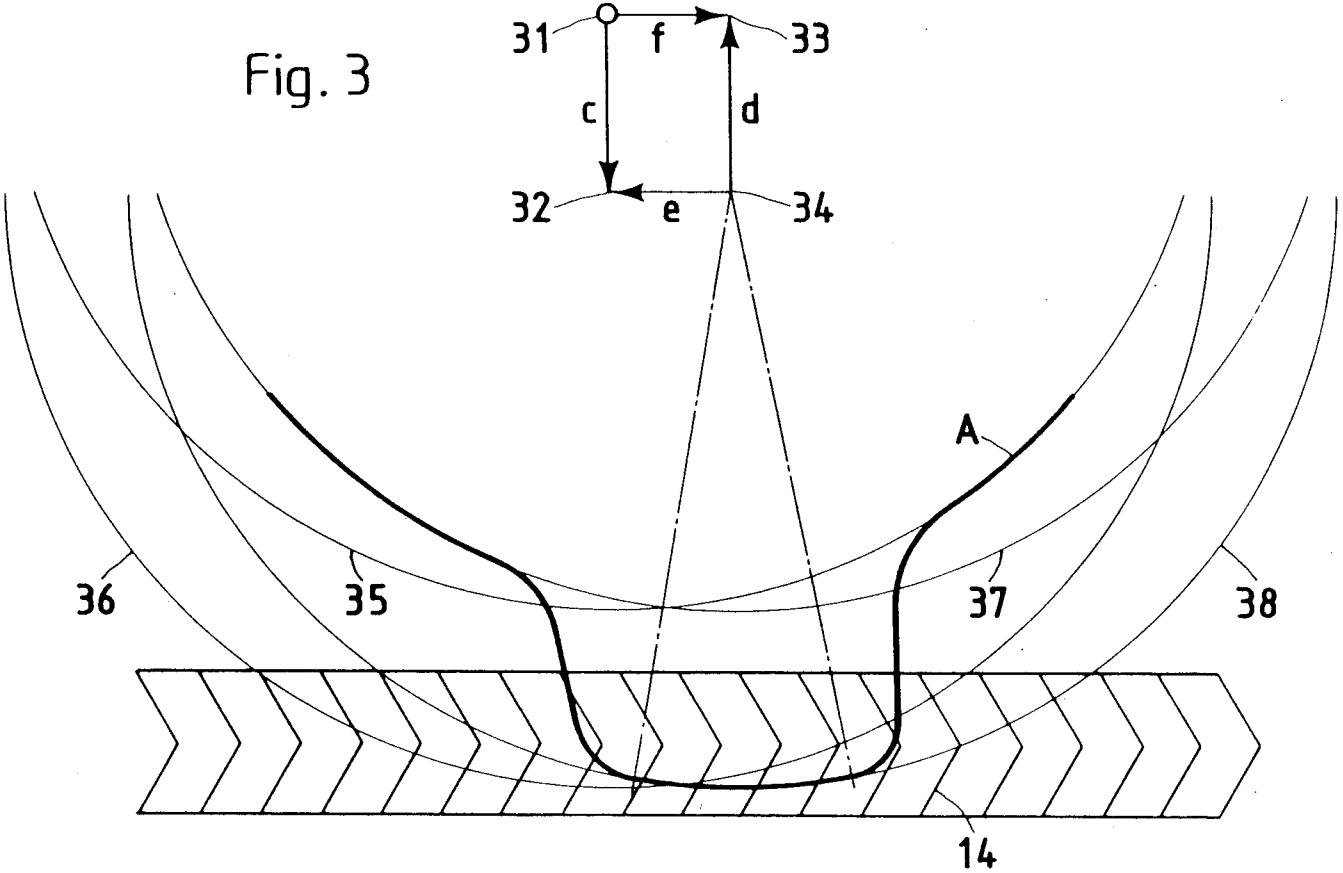
FIG. 3 is a schematic illustration of the cleaning apparatus depicted in FIG. 2 serving for purposes of explanation of the different movements thereof during the cleaning of the flats clothing.

For explanation of the sequence or course of movements of the cleaning brush or brush member 16 during this mode of operation, reference is made to FIG. 3. In FIG. 3 the relatively thickly drawn or heavy line illustrates the movements of a given point on the cleaning brush 16. This can be, for example, the point 39 depicted in FIG. 2. In such FIGS. 2 and 3 there is also depicted the flats clothing 14. The position 31 represents the disposition of the lengthwise or longitudinal axis 18 of the shaft or shaft member 17 before the start of the cleaning movement or movement component a of the cleaning brush 16 from the end or terminal position A; position 32 represents the disposition of the lengthwise or longitudinal axis 18 of the shaft 17 after performance of the movement or movement component c by means of the piston-and-cylinder unit 23; position 33 represents the disposition of the lengthwise or longitudinal axis 18 of the shaft 17 after performance of the movement or movement component f by means of the piston-and cylinder unit 29; and finally, position 34 represents the disposition of the lengthwise or longitudinal axis 18 of the shaft 17 after performance of both movements or movement components c and f. When the lengthwise or longitudinal axis 18 of the shaft 17 is located at one of the positions 31, 32, 33, 34, then the point 39 of the cleaning brush or brush member 16 carrying out a pivotal movement describes one of the illustrated circles. It will be appreciated that the circle 35 is associated with the position 31, the circle 36 with the position 32, the circle 37 with the position 33 and the circle 38 with the position 34.

If it is now assumed that after the start of the cleaning movement of the cleaning brush or brush member 16 which initiates the pivotal movement component a starting from the end position A and which is undertaken in order to clean the flats clothing 14, there are performed movements corresponding to the movement component c and thereafter corresponding to the movement component f, then the point 39 describes a path corresponding to the thickly drawn or heavy line. This extends initially along the circle 35 and finishes in the circle 38. In this example, after the cleaning brush or brush member 16 has passed almost completely through the flats cleaning position C and the movement component f is substantially completed, then the plates or plate members 20 are brought back to their position where they are spaced from the set of flats 13*a* at the flats cleaning position C by performance of the movement component d. In this way, the movement of the point 39 enters the circle 37 associated with the position 33. The performance or course of this operation is illustrated in FIG. 3. After completion of this course of movement of the cleaning brush 16 and before such cleaning brush 16 has again performed its return movement in accordance with the pivotal movement component b, at some stage a movement must be performed in accordance with the movement component e. This brings the cleaning brush 16, which arrives in the end or terminal position A at the end of its return pivotal movement b, back onto the circular path 35.

During the above-described mode of operation the movement or movement component f is performed during such time as the cleaning brush 16 moves past the cleaning position C. In this operating phase, the cleaning brush or brush member 16 intensively penetrates into the flats clothing 14, the depth of cleaning brush penetration being governed or determined by the selection of the dimensions of the movement component c. The speed with which the cleaning brush or brush member 16 moves through the clothing 14 is decelerated by the superposition of the movement component f upon the pivotal movement component a. Such cleaning brush speed of movement at that time is equal to the peripheral or circumferential velocity of the cleaning brush 16 determined by the rotational speed of such cleaning brush 16 and reduced by the speed of the movement component f. This results in an improved grasping of the undesirable materials or strips of the clothing 14 which are to be extracted therefrom. Additionally, the movement according to the movement component d is carried out at greater speed which makes itself felt in terms of accomplishing an effective snatching out or grasping of the undesirable materials or strips which is beneficially performed in a substantially vertically upward direction. The combination of these operations contributes to a markedly improved cleaning of the clothing 14.

It will be appreciated that due to the slower movement of the cleaning brush 16 penetrating into the flats clothing 14, the clothing strip processed during each cleaning movement or movement component a, when the cleaning brush moves from the end position A through the cleaning position C, becomes somewhat narrower and that the treatment or operative engagement of a narrower strip or region at the flats clothing 14 during the individual cleaning penetration movements of the cleaning brush 16 together with the slower movement of the cleaning brush 16 relative to the set of flats 13*a* gives better results than a more rapid cleaning procedure over a broader strip or region of the flats clothing 14.

Also in this exemplary embodiment, periodic movement of the cleaning brush 16 through the brush cleaning comb 28 is contemplated for accomplishing cleaning of the cleaning brush 16. However, in this embodiment, in contrast to the embodiment of FIG. 1, the brush cleaning comb 28 is not supported by the plates 20 forming a carrier or support 20*a* but is fixedly secured to the card framework or housing 54. Under these conditions, a particularly advantageous embodiment of the present invention is manifested by the features that in the operating phase, in which the cleaning brush 16 is located in the region of the end or terminal position B, during the cleaning movement component a before the passage of the cleaning brush 16 through the brush cleaning comb 28, the plates 20 are again subjected to a movement or movement component c, and thus, together with the path of movement of the cleaning brush 16, are again translated into their disposition close to the set of flats 13*a* at the cleaning position C. In this manner, penetration of the cleaning brush 16 into the comb 28 is avoided during the cleaning movement component a so that during this movement flats strips or accumulations 26 or the like are not pressed into the cleaning brush 16. Immediately upon the start of the return pivotal movement b of the cleaning brush 16 and before the latter has again arrived at the brush cleaning comb 28, a movement component d is once again performed and by virtue of which the plates or plate members 20 are again brought into their position spaced from the set of flats 13*a*. In this position, the teeth or bristles 28*a* of the brush cleaning comb 28 penetrate strongly into the cleaning brush clothing constituted by the needles or bristles 16*a* of the cleaning brush 16*a*, the teeth or bristles 28*a* of the brush cleaning comb 28 being located in operating position. This provides an improvement in cleaning of the cleaning brush 16 which, in turn, advantageously results in an improvement in cleaning of the clothing 14 of the set of flats 13*a* or individual flats 13 thereof.

It should be apparent that the embodiment of FIG. 2 permits many further variations in addition to the illustrated examples of possible operational modes. In dependence upon the sequence in which the movements or movement components a, b, c, d, e and f become effective and the selection of the speed of performance of these movements or movement components, adaptation to very variable conditions or encountered situations becomes readily possible.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A cleaning apparatus for cleaning the flats of a set of flats of a revolving flats card having a card framework and a carding zone, wherein each of the flats of the set of flats contain clothing and the set of flats possess a predeterminate width, comprising:

means defining a carrier located on a side of the flats of the set of flats which is provided with clothing;

a shaft having a lengthwise axis and supported for pivotal movement by the carrier;

a cleaning brush for cleaning the clothing of the flats of the set of flats and fixedly secured to said shaft for performing pivotal movements about the lengthwise axis of said shaft through a predeterminate path of movement;

means for displacing said shaft for accomplishing selective pivotal movements of said cleaning brush between two end positions through a predeterminate path of movement of the cleaning brush;

said cleaning brush when moving between said two end positions moving through an intermediate position therebetween defining a flats cleaning position located externally of the carding zone;

said cleaning brush when pivoting through said cleaning position passing over the clothing of the flats and extending over substantially the predeterminate width of the set of flats;

said displacing means for said shaft selectively pivoting said cleaning brush together with the shaft about the lengthwise axis thereof such that said cleaning brush performs pivotal movements alternatively comprising a cleaning movement and a return movement;

said cleaning movement being defined by movement of said cleaning brush from one end position towards the other end position while passing through said intermediate position;

said return movement being defined by movement of said cleaning brush from the other end position towards the one end position while passing through said intermediate position;

said set of flats having a longitudinal direction of extent;

means for movably mounting said carrier on the card framework;

said means for movably mounting said carrier on said card framework includes further means enabling said carrier to be additionally movable through translational movements extending substantially parallel to said longitudinal direction of extent of the set of flats at the flats cleaning position;

means for selectively controlling movement of the carrier such that there can be predeterminately varied the spacing of the predeterminate path of movement of the cleaning brush from the set of flats at the flats cleaning position, whereby during the cleaning movement of the cleaning brush said spacing is smaller than during the return movement;

said means for selectively controlling movement of the carrier comprising control means for controlling the path of movement of the cleaning brush with respect to the set of flats;

said control means during the cleaning movement of the cleaning brush, before arrival of the cleaning brush at the flats cleaning position, causing the carrier to move into a position close to the set of flats at the flats cleaning position;

said control means, before the passage of the cleaning brush through the flats cleaning position during the return movement of the cleaning brush, causing the carrier to move into a position spaced from the set of flats at the flats cleaning position; and said control means additionally effecting a movement of the carrier into a position spaced from the set of flats at the flats cleaning position during the cleaning movement before the end of the passage of the cleaning brush through the flats cleaning position.

2. The cleaning apparatus as defined in claim 1, wherein:

said means defining said carrier comprises plate means arranged at substantially right angles to the lengthwise axis of the shaft and supported by the card framework;

said means for movably mounting said carrier on the card framework comprises a carrier rod extending substantially parallel to the lengthwise axis of the shaft; and said carrier rod pivotably mounting said plate means in order to vary the spacing of the predeterminate path of movement of the cleaning brush from the set of flats.

3. The cleaning apparatus as defined in claim 2, wherein:

said cleaning brush includes clothing;

said set of flats having substantially linearly extending surface means at least at the flats cleaning position, and defining a plane; and said clothing of the cleaning brush at the flats cleaning position and said carrier rod are located at approximately the same height above said plane defined by the linearly extending surface means of the set of flats at the flats cleaning position.

4. The cleaning apparatus as defined in claim 1, further including:

a comb located along the predeterminate path of movement of the cleaning brush for cleaning the cleaning brush during pivotal movements thereof.

5. The cleaning apparatus as defined in claim 1, wherein:

said means defining said carrier comprises plate means arranged at substantially right angles to the lengthwise axis of the shaft and supported by the card framework;

said means for movably mounting said carrier on the card framework comprises a carrier rod extending substantially parallel to the lengthwise axis of the shaft;

said carrier rod pivotably mounting said plate means in order to vary the spacing of the predeterminate path of movement of the cleaning brush from the set of flats;

said set of flats have a longitudinal direction of extent;

said means for movably mounting said carrier on said card framework include further means enabling said carrier to be additionally movable through translational movements extending substantially parallel to said longitudinal direction of extent of the set of flats at the flats cleaning position; and said control means apart from controlling variation of the spacing of the carrier from the set of flats additionally serves to control the translational movements of the carrier, whereby during the cleaning movement, during passage of the cleaning brush through the cleaning position, a translational movement of the carrier is effected in a direction opposed to the direction of movement of the cleaning brush at the flats cleaning position and before the start of a subsequent cleaning movement said control means effectuates a translational movement of the carrier in an opposite direction back into a predetermined starting position.

6. The cleaning apparatus as defined in claim 1, further including:

a comb located along the predeterminate path of movement of the cleaning brush for cleaning the cleaning brush during pivotal movements thereof;

said comb being fixed to the card framework at a location disposed approximately opposite the flats cleaning position;

said control means, during the cleaning movement of the cleaning brush before the passage of the cleaning brush past the comb, effecting a movement of the carrier into a position disposed close to the set of flats at the flats cleaning position; and said control means, during the return movement of the cleaning brush before the passage of the cleaning brush through the comb, effecting a movement of the carrier into a position spaced from the set of flats at the flats cleaning position.

7. A cleaning apparatus for cleaning the set of flats of a revolving flats card having a card framework and a carding zone, wherein each of the flats of the set of flats contain clothing, comprising:

means defining a carrier located on a side of the flats of the set of flats which is provided with clothing;

a shaft having a lengthwise axis and movably supported by the carrier;

a cleaning brush for cleaning the clothing of the flats of the set of flats and fixedly secured to said shaft for movement about the lengthwise axis of said shaft;

means for displacing said shaft for accomplishing selective movements of said cleaning brush between two positions through a predeterminate path of movement of the cleaning brush;

said cleaning brush when moving between said two positions moving through an intermediate position therebetween defining a flats cleaning position located externally of the carding zone;

said cleaning brush when moving through said cleaning position passing over the clothing of the flats;

said displacing means for said shaft selectively moving said cleaning brush together with the shaft about the lengthwise axis thereof such that said cleaning brush performs movements comprising a cleaning movement and a return movement;

said cleaning movement being defined by motion of said cleaning brush from one position of said two positions towards the other position of said two positions while passing through said intermediate position;

said return movement being defined by motion of said cleaning brush from other position of said two positions towards the one position of said two positions while passing through said intermediate position;

means for movably mounting said carrier; and means for selectively controlling movement of the carrier such that there can be predeterminately varied the spacing of the cleaning brush from the set of flats at the flats cleaning position, whereby during the cleaning movement of the cleaning brush said spacing is smaller than during the return movement and the position of the cleaning brush with respect to each flat which is being momentarily cleaned can be selectively varied as the cleaning brush acts upon each said flat.

* * * * *